US005324041A

United States Patent [19]

Boylan et al.

[11] Patent Number: 5,324,041

[45] Date of Patent: Jun. 28, 1994

[54] HIGH CARD WAGERING GAME

[75] Inventors: Eugene E. Boylan, Zephyr Cove; David S. Schuger, Las Vegas; Russell R. Hebert, Minden; Robert F. Koerner, Gardnerville, all of Nev.

[73] Assignee: BET Technology, Inc., Carson City, Nev.

[21] Appl. No.: 51,790

[22] Filed: Apr. 26, 1993

[51] Int. Cl.[5] ..... A63F 1/00

[52] U.S. Cl. ..... 273/292; 273/309

[58] Field of Search ..... 273/292, 274, 309

[56] References Cited

U.S. PATENT DOCUMENTS

| | | | |
|---|---|---|---|
| 4,362,303 | 12/1982 | Pell | 273/274 |
| 4,651,997 | 3/1987 | Wood | 273/274 |
| 4,659,087 | 4/1987 | Shen et al. | 273/274 |
| 4,836,553 | 6/1989 | Suttle et al. | 273/292 |
| 5,072,946 | 12/1991 | Miller | 273/292 |
| 5,098,107 | 3/1992 | Boylan et al. | 273/292 |
| 5,141,234 | 8/1992 | Boylan et al. | 273/306 |

OTHER PUBLICATIONS

"Over/Under 13 Blackjack", Gaming Concepts, Inc. 1988.

"Games View", Games & Puzzles, Feb. 1976, p. 18.

Scarne's Encyclopedia of Games by John Scarne, Harper & Row, Publishers 1973, pp. 315-316, 360-361.

*Primary Examiner*—Benjamin H. Layno

*Attorney, Agent, or Firm*—Larson and Taylor

[57] ABSTRACT

A method of playing a wagering game based broadly on the "war" game is played where an ante bet is first made by each player and a card is then dealt to each player and to the dealer. It is then determined whether the card of the dealer has a greater value, a lesser value or an equal value to that of each player. The ante bet is then immediately paid off to each player with a higher value card than the dealer and to the dealer for each player with a value less than or equal to the dealer. Additionally, if the dealer ties a player, each tied player then (optionally) wagers a further bet (whose payoff odds are in favor of the player) which is followed by the dealing of at least one further card to each tied player and to the dealer to see who wins the further bet(s). The paying off of the further bet also preferably includes in the event of a further tie either a win to the dealer, a win to the player, or a further deal to the player and dealer. A tie bet that the player and dealer will tie can also be made by any player at the same time that the ante bet is wagered.

18 Claims, 1 Drawing Sheet

HIGH CARD WAGERING GAME

FIELD OF THE INVENTION

The present invention relates generally to a wagering card game and more particularly to a wagering "war" type game in which ties are possible and result in further wagering.

BACKGROUND OF THE INVENTION

The card game "war" is well known and played with great frequency. However, this game is not suited for use as a wagering game since the outcome is generally not determined for a long time after the commencing of the game. Further, the game is not suited for use as a casino type game which foremost requires a house advantage and which also generally requires fast-paced action and frequent betting.

SUMMARY OF THE INVENTION

In accordance with the present invention, a method of playing a wagering game based broadly on the "war" card game is provided. The wagering game is thus played between a player or a group of respective players and a dealer, with the outcome determined by randomly generated playing cards having various values (i.e., a deck or a plurality of decks of playing cards). In the method, an ante bet is first made by the or each player and a card is then dealt to the or each player and to the dealer by the dealer. It is then determined whether the card of the dealer has a greater value, a lesser value or an equal value to that of the or each player. The ante bet is then immediately paid off to (a) the or each player if the value of the card of the or each player is greater than the value of the card of the dealer, or (b) the dealer if the value of the card of the dealer is greater than or equal to the value of the card of the or each player.

Additionally, if the value of the card of the dealer equals that of any player, the or each tied player then (optionally) wagers a further bet which is followed by the dealing of at least one further card to the or each tied player and to the dealer. Then, as before with the originally dealt card, it is determined whether the further card of the dealer has a greater value, a lesser value or an equal value to the further card of the or each tied player. Depending on this determination, the further bet is paid off to (a) the or each tied player if the value of the further card of the or each tied player is greater than the value of the card of the dealer, or (b) the dealer if the value of the card of the dealer is greater than the value of the card of the or each tied player.

The paying off of the further bet also preferably includes one of the following steps, depending on the method of play desired for the wagering game where the value of the further card of the or any player is equal in value to that of the dealer. In one embodiment, there is the further step of dealing additional further cards to the or each tied player and dealer until one or the other has a card of greater value than the other in a deal and therefor wins the further bet. In a second embodiment, favoring the player, there is the step of paying off of the further bet to the or each tied player so that the or each tied player therefor wins the further bet when the further cards tie. As a third embodiment, favoring the dealer, there is the step of paying off of the further bet to the dealer so that the dealer therefor wins the further bet when the further cards tie.

In the preferred embodiment of playing the wagering game of the present invention, the wagering of the further bet step includes the step of accepting only further wagers of equal or lesser value than the ante wager of the particular player. With such a step, the paying off of the ante bet to the player step preferably includes the step of paying back to the player an amount equal to the ante bet of that player and the paying back to the player a payoff of at least 1.5:1 of any further bet which is won by the player.

To provide for further betting, the method of the present invention also includes the step of wagering a tie bet by the or any player at the same time that the ante bet is wagered. Then, after the first determining step, the tie bet is paid off to the or any player if the value of the card of the dealer is equal to the value of the card of the player making the tie bet. Preferably, the paying off of the tie bet includes the step of paying back to the player a payoff of at least 8:1 of the tie bet.

To add more suspense to the game, the dealing of at least one further card step includes the step of dealing at least one burn or face down card before dealing the further card to the or each player and the dealer. In addition, the dealing of at least one further card step includes the step of selecting the number of burn cards to deal by use of a chance generating mechanism.

If desired, the wagering game could also include the step of wagering an association bet by the or any player at the same time that the ante bet is wagered. Then, after the first determining step, there would be a step of paying off of the association bet to the or any player if there is a predetermined association between the card of the dealer and the card of the player making the association bet.

It is an object of the present invention to provide a wagering game which generates increased interest and participation.

It is also an object of the present invention to provide a wagering game with increased opportunities to wage in addition to those found in a usual wagering game.

It is another object of the present invention to provide a wagering game which achieves the above-noted object and in addition is simple and easily understood.

Other features, objects and advantages of the present invention are stated in or apparent from detailed descriptions of presently preferred embodiments of the invention found hereinbelow.

DETAILED DESCRIPTION OF THE PREFERRED EMBODIMENTS

Figure 1:
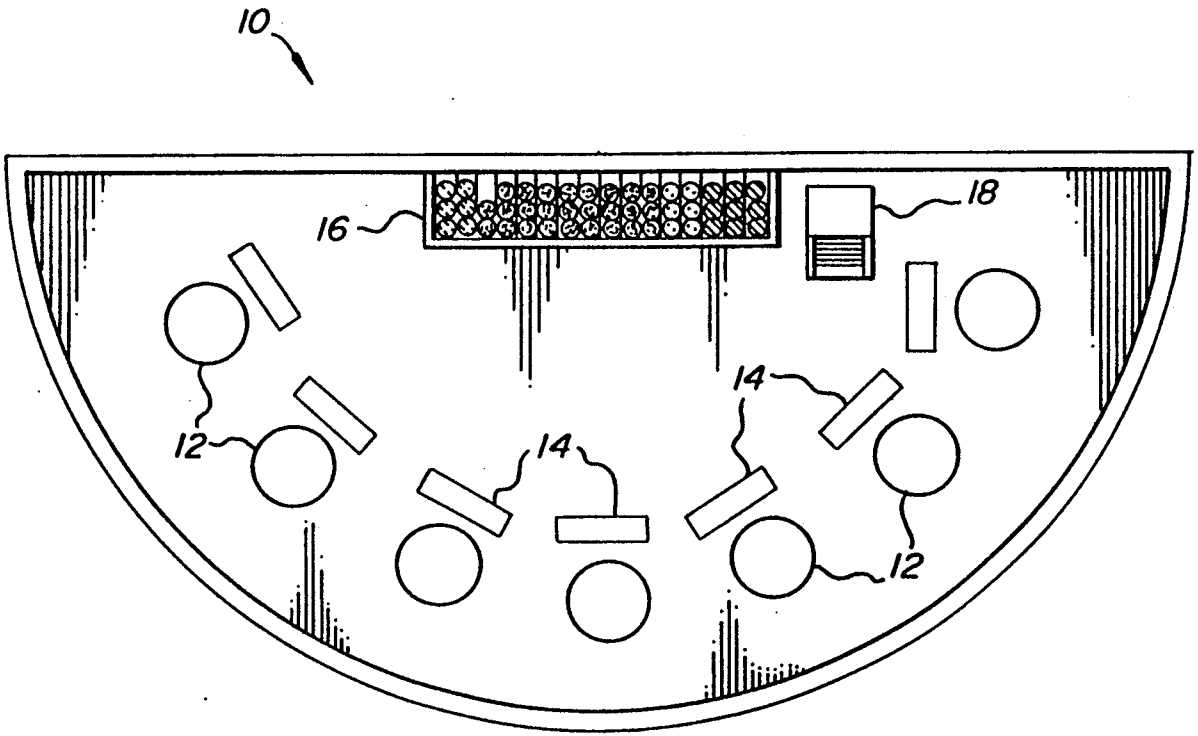
FIG. 1 is a schematic representation of a betting display surface for a wagering game according to the present invention.

With reference now to the drawing in which like numerals represent like elements, the wagering game of the present invention is preferably played using a casino type display means 10 as depicted. However, while the present invention is explained in the context of a casino game hereinbelow, it will be appreciated that the wagering game is adaptable for home use or as an electronic game using the principals discussed. It will also be appreciated that although the wagering game is designed to have the highest value card the winner, it could instead be the lowest card or there could be other means of designating the winning card besides values.

Display means 10 includes, for each of a plurality of players (in this case 7), an area 12 for placing an ante bet and an area 14 for placing of a tie bet. The dealer is located adjacent a settling means or bank 16, with a shoe 18 containing a plurality of decks (such as eight) of regular playing cards located adjacent thereto. Of course, special cards or a different mechanism for displaying regular cards (such as electronic) could be used if desired.

In order to play a round of the wagering game of the present invention, each player initially makes an ante bet by placing a suitable token (chip, money, etc.) or tokens on area 12. Obviously, each player participating must place some ante bet, with a minimum (and possible maximum) ante bet or set ante bet typically designated. At the same time, each player may also choose to place a tie bet on area 14, also as designated (as of some predetermined minimum value).

After all (mandatory) ante bets and (optional) tie bets are placed by the players, the dealer then deals one card, face up, to each of the players as well as a face up card to himself. Taking each player in turn, the dealer then determines whether the numerical value of the card of the player is greater than, less than, or equal to that of the dealer's card. If the value of the card of the player is less than or equal to that of the dealer, the player loses the ante bet which is immediately collected from area 12 by the dealer. On the other hand, if the value of the card of the player is greater than that of the dealer, the player wins and the dealer immediately pays the player an amount which in this embodiment is equal to the ante bet of that player. Using eight decks in shoe 18, it will be appreciated that the dealer hold percentage on ante bets (the amount the dealer will be expected to win in view of the odds being in his favor, due to the dealer winning all ties) will be about 7.47%.

In addition, as the dealer determines whether the player wins or loses the ante bet, the dealer also determines if the player made a tie bet. If a tie bet was made and the value of the card of the player and dealer are equal (note that the player loses the ante bet as described above), the player wins the tie bet and the dealer immediately pays off the tie bet. The payoff of the tie bet is preferably set at a relatively high amount in view of the low odds of winning such a bet by the player, with a minimum of about 8:1 and preferably about 10:1 used in accordance with the present invention. With odds of 10:1, the dealer hold percentage on tie bets would be about 17.83%, as ties would only occur about 7.47% of the time.

When a tie does occur, and after all of the ante bets and tie bets are paid off, the dealer will then also offer the tieing player(s) the option of making a further bet in area 12 (now cleared). This offer of a further bet is made regardless of whether a tie bet was made by the tieing player. The further bet is limited to an amount equal to or less than the ante bet, and has a payoff at least equal to about 1.5:1. It will be appreciated that any payoff greater than 1:1 (or 1:0747:1 if ties go to the dealer) on the further bet will mean that the odds are in the favor of the player. Thus, a payoff of at least 1.5:1 significantly encourages the players to make further bets and stimulates interest in the game.

To determine the winner of the further bet, the dealer then deals an additional face up card to each player making such a further bet and to himself. As traditional with the "war" game, the face up card can be dealt after first "burning" or dealing three (or some other predetermined number) face down cards. After dealing the further cards, the dealer then determines whether the further card of each player has a value greater than, less than, or equal to that of the dealer. If the value of the further card of the player is less than that of the dealer, the player loses and the dealer collects the further bet from area 12. On the other hand, if the value of the card of the player is greater than that of the dealer, the player wins and the dealer immediately pays the player an amount which in this embodiment is equal to at least 1.5 times the further bet of that player.

It will be appreciated that it is also possible for the further cards of the player and the dealer to be tied. In such situations, three choices are possible and the one chosen will depend on how the dealer (or casino owner) wants to have the method of the game proceed. If it is desired to speed up play, the tie of the further cards can be designated as a win to the player (to increase the odds for the player winning a further bet), or to the dealer (to lower the odds for the player winning the further bet, but with the overall odds still much in the player's favor). As a third option, another round of further cards could be dealt and the winner determined by that round, or succeeding rounds (in case of further ties) until either the player or dealer is a winner. While accommodations could be made for receiving further bets after a tie on a first further bet, this would probably complicate the game to a greater degree than desired and also slow up play which would not be desired. Therefore, the preferred embodiment of the wagering game of the present invention would provide for only one further bet.

As the odds are in the favor of the player when a further bet is made (due to the increased payoff), this will lower the overall dealer hold percentage. However, as the opportunity for further bets will be available only infrequently (i.e., about 7.47% of the time) and even though such further bets will almost always be made when the opportunity presents itself (in view of the odds being in favor of the player for that wager), there is only a relatively small reduction in the overall dealer hold percentage for the dealer. For example, in the situation where the further bet payoff is 2:1 and the dealer wins ties on the further bet, the player hold percentage for the further bet itself is about 38.9%. However, as this occurs only infrequently, the overall dealer hold percentage is only reduced by about 2.9% (i.e., 38.9%×7.47%). Therefore, using the dealer hold percentage of 7.47% mentioned above, there is obviously still a definite advantage of about 4.6% to the dealer.

Depending on the desires of the dealer, or if used in a casino the casino owner (or game commission which controls the overall hold percentage of the casino), the odds can be adjusted as desired. For example, while the minimum payoffs for the tie wager have been suggested as 8:1, and preferably 10:1, this payoff could be made as high as desired (even positive for the player, such as 15:1). Similarly, the payoffs for the further bets could be some other ratio, besides the 1.5:1 or 2:1 mentioned, such as or 2.5:1. The only limiting factor would have to be that the payoffs for all bets remains in the favor of the dealer or house (assuming that having an overall winnings is desired).

While the determination of the number of face down cards dealt for each further bet can be predetermined, it would also be possible for the number to be determined each time a further bet (or round of further bets) is made. For example, some suitable chance generating mechanism such as a six-faced die could be used to chose between zero to five face down cards or between one to three (with each number appearing on two faces). If desired, there could even be a separately colored die for the tied player or players each round and one for the dealer so that the number of face down cards of the players could be different from those of the dealer. In such a situation, the first tied player would throw both dies to determine the face down cards for the player(s) and the dealer. Such a chance generating mechanism also adds an additional security feature into the play of the game which may be important for casino operators.

In addition to the bets noted above, it would also be possible to provide additional no-value cards to the shoe so that a separate wager could also be made on whether a (or two) no-value card would be dealt (to a player, to any player, to the dealer, or to any participant). Such a wagering method is disclosed in U.S. Pat. No. 5,098,107, which is hereby incorporated by reference. This patent also discloses the use of an association wager which could be used with the present game where the bet would be that there would be some predetermined association of the cards between the player and the dealer. For example, that the cards would be of the same suit or in order. Similarly, the use of a progressive jackpot as disclosed in the patent could also be adapted to the present wagering game if desired.

As another variation, the present wagering game could also be played as a player banked card game with a kind of poker betting. In this embodiment, each player would initially wager an ante and the dealer (chosen on a rotating basis) would deal each player one card face down. Then, the first player to the dealer's left (or whatever) would have the option of making an initial wager. If an initial wager were not made, then each player in turn would have the option of making an initial wager. After an initial wager is made, each succeeding player would then either call, fold or raise the previous wager in the same manner as in poker games. At the conclusion of the betting, the remaining players would disclose their cards with the highest value card being the winner. Any ties for the highest value (winning) card would be played out in a further deal or "war" between the tied players, including further betting in the same manner as noted above for the initial deal.

While the present invention has been described with respect to exemplary embodiments thereof, it will be understood by those of ordinary skill in the art that other variations and modifications can be effected within the scope and spirit of the invention.

We claim:

1. A method of playing a wagering game between a player or a group of respective players and a dealer whose outcome is determined by randomly generated playing cards having various values comprising the steps of:

arranging only one single stack of playing cards;

wagering an ante bet by the or each player;

dealing of only one card successively from the single stack of the playing cards only to the or each player and to the dealer by the dealer;

determining whether the card of the dealer has a greater value, a lesser value or an equal value to that of the or each player;

paying off of the ante bet to (a) the or each player if the value of the card of the or each player is greater than the value of the card of the dealer, or (b) the dealer if the value of the card of the dealer is greater than or equal to the value of the card of the or each player; and if the value of the card of the dealer equals that of any player, wagering of a further bet by the or each tied player, dealing successively from the stack of at least one further card only to the or each tied player and to the dealer, and determining whether the further card of the dealer has a greater value, a lesser value or an equal value to the further card of the or each tied player, and paying off of the further bet to (a) the or each tied player if the value of the further card of the or each tied player is greater than the value of the card of the dealer, or (b) the dealer if the value of the card of the dealer is greater than the value of the card of the or each tied player.

2. A method of playing a wagering game as claimed in claim 1 wherein the paying off of the further bet step includes the step of dealing successively from the stack additional further cards to the or each tied player and the dealer where the previous further cards of the player and dealer in a deal were of equal value until one or the other has a card of greater value than the other in a deal and therefor wins the further bet.

3. A method of playing a wagering game as claimed in claim 1 wherein the paying off of the further bet step includes the step of paying off of the further bet to the or each tied player where the further card of the player is tied with that of the dealer so that the or each tied player therefor wins the further bet.

4. A method of playing a wagering game as claimed in claim 1 wherein the paying off of the further bet step includes the step of paying off of the further bet to the dealer where the further card of the player is tied with that of the dealer so that the dealer therefor wins the further bet.

5. A method of playing a wagering game as claimed in claim 1 wherein the wagering of the further bet step includes the step of accepting only further wagers of equal or lesser value than the ante wager of that particular player.

6. A method of playing a wagering game as claimed in claim 5 wherein the paying off of the ante bet to the player step includes the step of paying back to the player an amount equal to the ante bet of that player.

7. A method of playing a wagering game as claimed in claim 6 wherein the paying off of the further bet step includes the step of paying back to the player a payoff of at least 1.5:1 of the further bet.

8. A method of playing a wagering game as claimed in claim 7 and further including the step of wagering a tie bet by the or any player at the same time that the ante bet is wagered, and after the first determining step the paying off of the tie bet to the or any player if the value of the card of the dealer is equal to the value of the card of the player making the tie bet.

9. A method of playing a wagering game as claimed in claim 8 wherein the paying off of the tie bet includes the step of paying back to the player a payoff of at least 8:1 of the tie bet.

10. A method of playing a wagering game as claimed in claim 9 wherein said dealing of at least one further card step includes the step of dealing successively from the stock at least one burn card before dealing the further card to the or each player and the dealer.

11. A method of playing a wagering game as claimed in claim 10 wherein said dealing of at least one further card step includes the step of selecting the number of burn cards to deal by use of a chance generating mechanism.

12. A method of playing a wagering game as claimed in claim 11 and further including the step of wagering an association bet by the or any player at the same time that the ante bet is wagered, and after the first determining step the paying off of the association bet to the or any player if there is a predetermined association between the card of the dealer and the card of the player making the association bet.

13. A method of playing a wagering game as claimed in claim 1 and further including the step of wagering a tie bet by the or any player at the same time that the ante bet is wagered, and after the first determining step the paying off of the tie bet to the or any player if the value of the card of the dealer is equal to the value of the card of the player making the tie bet.

14. A method of playing a wagering game as claimed in claim 13 wherein the paying off of the tie bet includes the step of paying back to the player a payoff of at least 8:1 of the tie bet.

15. A method of playing a wagering game as claimed in claim 13 wherein said dealing of at least one further card step includes the step of dealing successively from the stack at least one burn card before dealing the further card to the or each player and the dealer after the step of selecting the number of burn cards to deal by use of a chance generating mechanism.

16. A method of playing a wagering game as claimed in claim 1 wherein said dealing of at least one further card step includes the step of dealing successively from the stack at least one burn card before dealing the further card to the or each player and the dealer.

17. A method of playing a wagering game as claimed in claim 16 wherein said dealing of at least one further card step includes the step of selecting the number of burn cards to deal by use of a chance generating mechanism.

18. A method of playing a wagering game as claimed in claim 1 and further including the step of wagering an association bet by the or any player at the same time that the ante bet is wagered, and after the first determining step the paying off of the association bet to the or any player if there is a predetermined association between the card of the dealer and the card of the player making the association bet.

* * * * *